US005334100A

United States Patent [19]

Bailey

[11] Patent Number: 5,334,100

[45] Date of Patent: Aug. 2, 1994

[54] SAFE BIRLING

[76] Inventor: Ken Bailey, 3800 Anderson Street, Whitby, Ontario, Canada, L1N 5R5

[21] Appl. No.: 18,105

[22] Filed: Feb. 17, 1993

[51] Int. Cl.[5] ..... A63B 23/06

[52] U.S. Cl. ..... 472/127; 472/129

[58] Field of Search ..... 472/127, 128, 129, 135; 441/133, 129, 136

[56] References Cited

U.S. PATENT DOCUMENTS 3,701,527 10/1972 Beaton ..... 472/127

3,845,952 11/1974 McKinney ..... 472/127

FOREIGN PATENT DOCUMENTS 1008098 5/1977 Canada .

*Primary Examiner*—Carl D. Friedman

*Assistant Examiner*—Kien Nguyen

*Attorney, Agent, or Firm*—Bauer & Schaffer

[57] ABSTRACT

The preferred embodiment of the invention is a safe birling amusement for use in swimming pools, in which a rotating central cylinder is flanked longitudinally by two stationary approach cylinders with flattened tops; pipes extending through the centers of all three cylinders support the structure, and these support pipes are set in adjustable brackets in two facing vertical walls of the pool. All three cylinders are covered with soft foam, and a foam guard is placed over the bracket and poolside surface; thus approach to the birling cylinder is easy and safe. As well, the rotational speed of the birling cylinder is decreased by virtue of paddle-wheels within that contact the pool water; this allows users to balance more easily.

19 Claims, 3 Drawing Sheets

14
15
16
22
27
28
29
31
32
34
40

20
22
40
16
26
14
16
27
26
30
40
22
33
31
20

26
27
16
26
30
27
40
22
33
31

SAFE BIRLING

INTRODUCTION AND DESCRIPTION OF THE PRIOR ART

One of the more amusing water sports is log-rolling or birling, and contests of skill in this regard have long been a major attraction at festivals of loggers and others who work or dwell near bodies of water. Like many folk pastimes, a risk is involved in this activity; the unsure looting of a rough log, and the possible crack on the head (and real risk of drowning) occasioned by a fall, ensure that careful attention is paid by the participants to their footing.

A number of inventors have attempted to bring birling to a larger user-group, but most of these devices, while interesting, are still dangerous. For instance, Canadian Patent No. 1,008,098, Water Tumbler and Roller Float, Brubacher, has helical screw-shape projections from an ellipsoid body which floats freely and would be very difficult to control; U.S. Pat. No. 3,260,523, Brown, specifies a number of right-angular steps which rotate around a central axis; a fall would hit a projecting step edge. Similarly U.S. Pat. No. 3,223,411; U.S. Pat. No. 3,701,527; and U.S. Pat. No. 3,379,437 have sharp projections near the birling surface. And some such as U.S. Pat. No. 3,887,179, Klepper, are made to be set up on land. Not only is the support-structure hard, but it's tempting to set such a device up in places with convenient flat surfaces, such as wood or concrete flooring; a fall can be very painful. (And a main amusement aspect of birling—the fall into water—is sadly lacking in such replacements). One device of relatively simple design that is at first glance not overtly dangerous is specified in U.S. Pat. No. 2,186,606, Hutchinson; but it's a bit too simple: a log-shape cylinder floating in water and fastened underneath at the center; free to rotate about a central vertical axis as well as about a central horizontal axis like other birling devices. This would require as much skill as a simple log to mount, and so is not really an amusement available to all; falls would be too frequent. And finally U.S. Pat. No. 3,116,925, while making some improvements, also falls prey to a lack of stability and dangerous projections: it's a cylinder held in a swimming pool by chains at either end. One can only mount from the water, and there is a danger of falling on the chains. As well, the chains will only provide partial lateral stability, so that the skill-level required for staying on top of the device will approach the previous-mentioned example, and falls will again be frequent.

In contrast, the present invention takes the form of a well-padded rotating cylinder flanked longitudinally by two non-rotating cylinder-shaped supports, which are in turn fastened securely to brackets on the inner sidewalls of a swimming pool. The user merely walks onto a cylinder-support from the poolside and then onto the rotating birling cylinder. The supports conveniently have a flattened surface for good footing, and both supports and birling cylinder have padded outer covering. As well, the mounting bracket has a portion on the poolside surface which is covered with a safety pad. And in order to provide required inertia in the birling cylinder—so it won't roll too fast, which would be difficult to negotiate—paddle-wheels on the inside of the birling cylinder ends slow down the rolling action.

An object of the present invention is to provide an amusement apparatus for birling, or balancing on a rotating cylinder, comprising; a birling cylinder strong enough to bear the weight of at least two persons, and having a coating on its longitudinal surface soft enough to prevent injury in common falls from a standing position; rotation control means to slow, speed, stop, or start the rotation of the birling cylinder; fastening means to position the birling cylinder horizontally in water between two members or walls, such as containing walls of a swimming pool; and access means to allow walking to the birling cylinder without entering the water; the access means being formed in a manner to prevent injury in common falls from a standing position. Using this apparatus a person can walk from a poolside surface to the birling cylinder and balance there, or climb from water in the pool onto the birling cylinder and balance there, such that if the rotation of said cylinder, or any loss of footing or any other common reason such as playful pushing causes the person to lose their balance and fall either on the cylinder or the access means, no injury will result.

Another object of the invention is to provide an apparatus for birling in a swimming pool consisting in:

(a) a birling cylinder, consisting in; (i) a birling pipe of plastic or similar strong material, characteristically of eighteen to twenty-four inch diameter, covered longitudinally with a characteristically one inch thick poly sponge or other cushioning coating; (it) two paddle wheels, one at each end of and within the birling pipe, and each consisting of several vanes affixed to.the inner surface of this pipe, oriented parallel to the pipe's longitudinal central axis, and radially extending from the pipe towards its central axis; (iii) a birling cylinder support pipe, characteristically metal and three inches in diameter, to which said vanes affix;

(b) two stationary platform cylinders, characteristically of the same diameter and coating as the birling cylinder, except flattened on top to afford safe walking; each oriented longitudinally parallel to the birling cylinder and extending between one end of the birling cylinder and one of two facing vertical walls of the swimming pool; and each having a central platform support pipe running longitudinally through it;

(c) a non-rotating main support pipe characteristically of metal and two-inch diameter, running centrally through the birling cylinder support pipe; and through the platform support pipes and firmly affixed thereto;

(d) ball-bearings of some suitably strong substance which will not corrode in water, arrayed between the main support pipe and the birling cylinder support pipe, characteristically on twelve-inch centers; and (e) two mounting brackets, each of which is affixed by known means to one of the walls, such that a line drawn between the centers of the brackets is horizontal and perpendicular to the walls; the main support pipe or the platform support pipes or both being mounted in the mounting brackets;

whereby a person may step directly from a patio or other poolside surface onto one of the platform cylinders and therefrom onto the birling cylinder, and may by movement of their feet or other body parts initiate the rotation of the cylinder, which then rotates relative to the main support pipe by virtue of the ball bearings, while being slowed by water in the pool contacting the paddle-wheel vanes; and whereby any person falling, pushed, or;jumping onto any portion of the birling cylinder or platforms will strike a soft surface. This apparatus could also have a safety pad, characteristically of cushioning foam, mounted on the poolside surface or patio adjacent to each platform cylinder, and covering any exposed portions of the mounting brackets; these mounting brackets could have a portion that extends horizontally across and contacts the poolside or patio surface, with the horizontal portion being under the safety pad; and these mounting brackets could be adjustable so that the main support pipe may be affixed at different heights relative to water level.

It is also an object to provide for such an apparatus in which the platform cylinders are impervious to water and buoyant, and optionally filled with a flotation material such as foam.

DETAILED DESCRIPTION OF THE INVENTION

Figure 1:
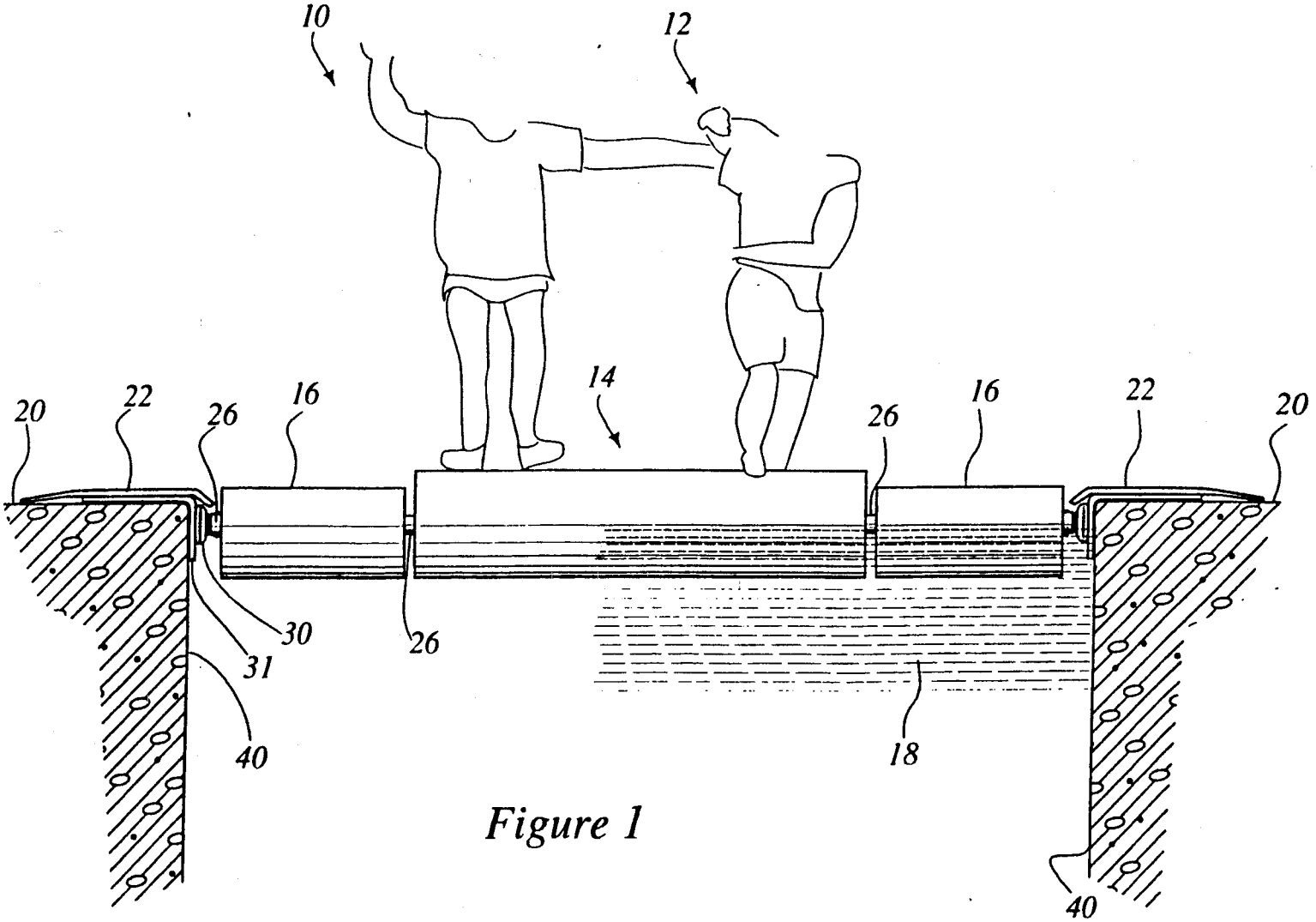
Figures 2A, 2B:
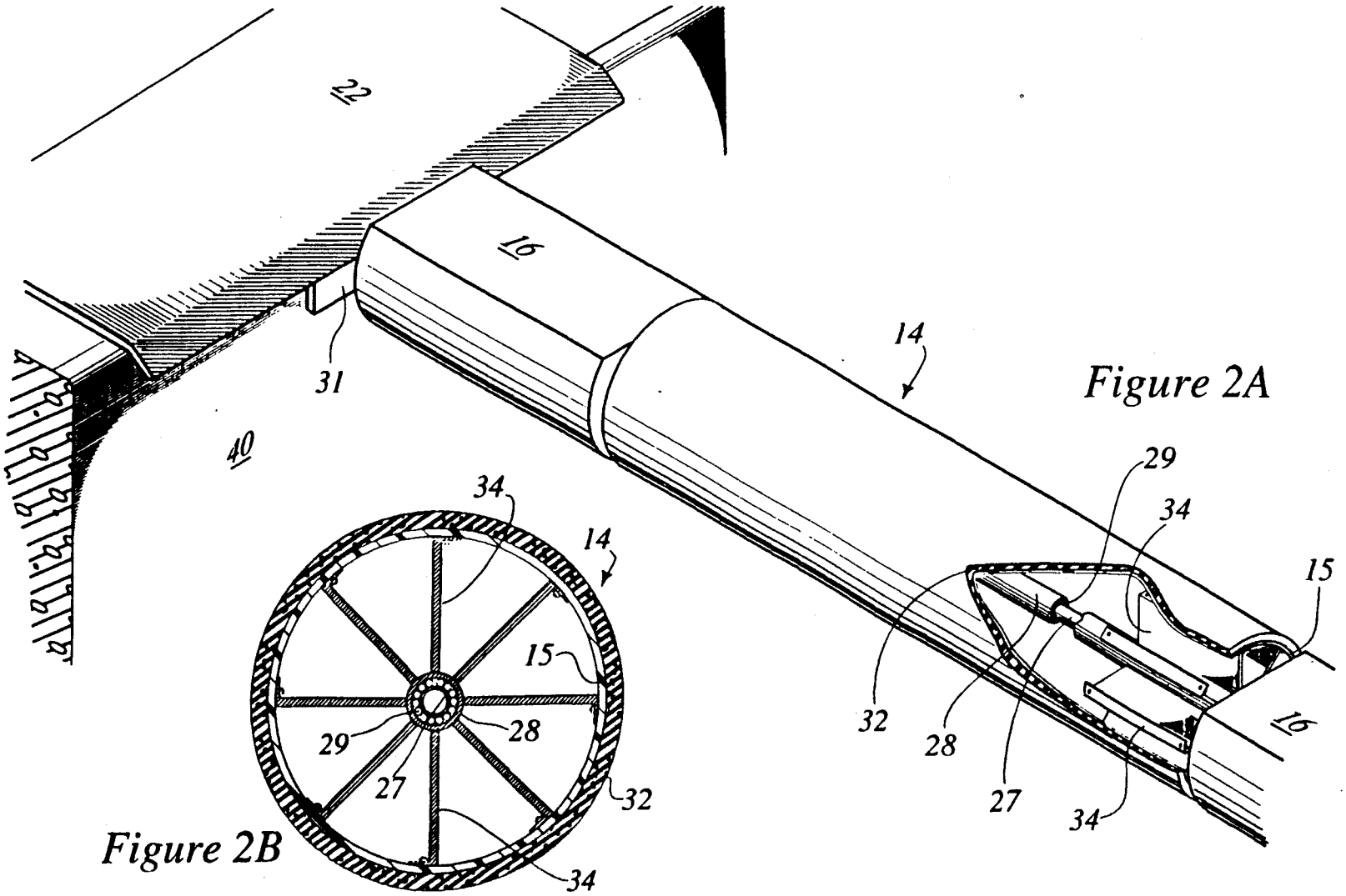
Figures 3A, 3B:
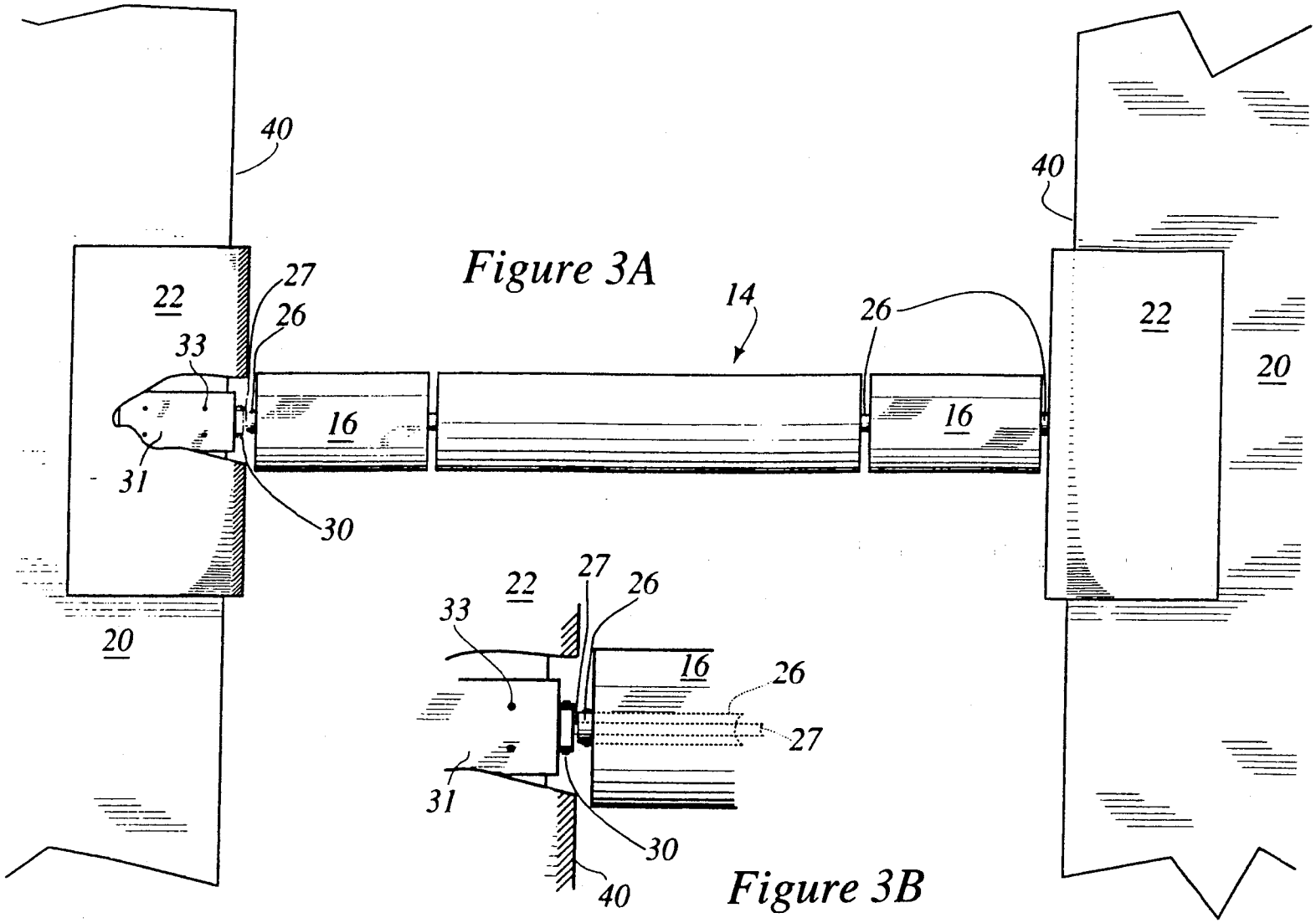

For this description refer to the following diagrams, wherein like numerals refer to like parts:

FIG. 1, the invented birling amusement in use, front elevation view;

FIG. 2A, cut-away of the invented amusement showing paddle wheel blades and pipe supports; perspective view;

FIG. 2B, invented birling cylinder, side (end) elevation section;

FIG. 3, invented amusement, with cut-away showing one mounting bracket; plan view; and FIG. 3B, detail of bracket from FIG. 3; cut-away plan view.

An example of the invented birling amusement in use is illustrated in FIG. 1, where birlers 10 and i 2 are balancing on top of birling cylinder generally indicated at 14. They may have reached this position by walking from poolside surface 20 over foam guard 22 and across non-rotating platforms 16, or by climbing out of water I 8. Best seen on FIGS. 2A and 2B, birling cylinder 14 is composed of a characteristically plastic birling frame cylinder 15 supported centrally by birling pipe support 28, which rotates, and main pipe support 27, which does not. Platforms 16, characteristically filled with a poly foam flotation filler (not shown) are affixed to and supported centrally by non-rotating platform pipe support 26, best seen on FIG. 1 and 3 and 3B; and also by main pipe support 27. In FIG. 3 and best in FIG. 3B, these pipe supports 26 and 27 can be seen as they fit into a conventional bracket 30. (In FIG. 3B pipes 26 and 27 are shown ghosted where they pass within support platform 16. Use of such a bracket 30 allows the birling cylinder 14 and connected platforms 16 to be raised or lowered relative to water 18 (seen on FIG. 1 only) or poolside surface 20. Bracket 30 is firmly affixed to or integral with bracket mount 31, which is visible on all Figures but shown most fully on top plan FIG. 3, where part of one foam guard 22 is shown cut-away to reveal bracket mount 31 and attached bracket 30. Mount 31 is attached to poolside surface 20 by bolts 33 or some other known method, and to pool inner surface 40 by some similar conventional means (not shown).

Both frame cylinder 15 and platforms 16 are covered with some soft material such as poly sponge 32 shown in the cut-away section of FIG. 2A and in FIG. 2B, which is a cross-section of the birling cylinder 14. Here can be clearly seen another aspect of the invention; paddle-wheel blades 34 will strike the water not shown in FIG. 2) and so prevent birling cylinder 14 from spinning too fast, which would make balancing very difficult. Birling cylinder 14 is hollow, and thus partially filled with water. Blades 34 extend into birling cylinder 14 at each end of cylinder 14, about one foot, to provide resistance; in the rotation of the cylinder 14, which, without blades 34, would tend to rotate too fast for safe birling. In this example, the blades 34 are also present, although not visible, inside the non-cut-away end of the birling cylinder 14 illustrated in FIG. 2A. Finally, seen best in FIG. 2B but visible also in the deepest cut-away in FIG. 2A, ball-bearings 29 (or some other appropriate known mechanism) allow easy rotation of birling pipe support 28 and hence attached birling cylinder 14, relative to main pipe support 27. In the preferred embodiment, these ball-bearings 29 are at 12-inch centers, and are formed of some appropriate strong non-corrosive material.

Especially with reference to FIG. 3, which shows the view that a birler would see underfoot, it can be appreciated that all surfaces near the birling cylinder 14 that a foot, elbow, hand, or head could possibly strike are soft, since the spaces between birling cylinder 14 and supports 16, and between supports 16 and foam guards 22, are too small to allow entry of any of the aforementioned appendages (these relative dimensions can be better appreciated by referring to birlers 10 and 12 on FIG. 1 ).

During installation and removal of birling cylinder 14, that is, when pipe supports 26 and 27 are not fixed in bracket 30, flotation is provided by support platforms 16, which are closed and buoyant, and, as mentioned, preferably filled with foam.

The foregoing is by example only, and the scope of the invention should be limited only by the appended claims.

The embodiments of the Invention in which an exclusive property or privilege is claimed are defined as follows:

1. An amusement apparatus for birling, or balancing on a rotating cylinder, comprising:

a birling cylinder strong enough to bear the weight of at least two persons, and having a coating on its longitudinal surface soft enough to prevent injury in common falls from a standing position;

rotation control means to slow, speed, stop, or start the rotation of the birling cylinder;

fastening means to position the birling cylinder horizontally in water between two members or walls, such as containing walls of a swimming pool; and access means to allow walking to the birling cylinder without entering the water; said means comprising two stationary platform cylinders flattened on top and covered with a soft protective coating, each of which is oriented longitudinally parallel to the birling cylinder and extends between one end of the birling cylinder and one of two said members or walls in a manner to prevent injury in common falls from a standing position;

whereby a person can walk from a poolside surface to the birling cylinder and balance there, or climb from water in the pool onto the birling cylinder and balance there, such that if the rotation of said cylinder, or any loss of footing or any other common reason such as playful pushing causes the person to lose their balance and fall either on said cylinder or the access means, no injury will result.

2. An apparatus as in claim 1, in which the rotation control means consists partly in forces applied by persons externally on said cylinder, such as the feet of one or more birlers, and partly in the inertia of the birling cylinder.

3. An apparatus as in claim 2, in which the rotation control means additionally consists in a paddle-wheel oriented longitudinally inside the birling cylinder, such that the paddle-wheel will contact water and thereby slow the rotation of the birling cylinder.

4. An apparatus as in claim 3, in which the fastening means consists in an inner and an outer support pipe running longitudinally through the birling cylinder, at least one of said pipes being fastened to brackets affixed to said members or walls; and in which the inner support pipe is non-rotating.

5. An apparatus as in claim 1, in which the fastening means consists in one or more support pipes running longitudinally through the birling cylinder and fastened to brackets affixed to said members or walls.

6. An apparatus as in claim 5, in which any portion of said brackets which may be contacted by a person's foot or other body pan are covered with a soft protective coating.

7. An apparatus as in claim 1, in which the fastening means consists in an inner non-rotating main support pipe running longitudinally through the birling cylinder and two platform cylinders and fastened to brackets affixed to said members or walls; a platform support pipe affixed around said main pipe and to the two platform cylinders, and optionally to said brackets; a birling cylinder support pipe affixed to and rotating with the birling cylinder; and ball bearings or other known means to allow smooth rotation of the birling cylinder pipe relative to the inner main support pipe.

8. An apparatus as in claim 7, in which the rotation control means consists partly or wholly in a paddle-wheel oriented longitudinally inside the birling cylinder, such that the paddle-wheel will contact water and thereby slow the rotation of the birling cylinder.

9. An apparatus as in claim 7, in which any portion of said brackets which may be contacted by a person's foot or other body pan are covered with a soft protective coating.

10. An apparatus for birling in a swimming pool consisting in:

(a) birling cylinder, consisting in: a plastic birling pipe with a soft protective coating; paddle wheels within the birling pipe with vanes radially extending from said pipe towards said pipe's central axis; and a birling cylinder support pipe to which said vanes affix;

(b) two stationary platform cylinders flattened on top to afford safe walking and oriented longitudinally parallel to the birling cylinder, each extending between one end of the birling cylinder and one of two walls of the swimming pool; and each platform cylinder having a central platform support pipe;

(c) a non-rotating main support pipe running centrally through the birling cylinder support pipe; and through the platform support pipes and affixed thereto;

(d) means of ensuring the tree rotation of the birling cylinder support pipe relative to the main support pipe; and (e) brackets to affix the ends of the main support pipe, or the platform support pipe, or both, to the two walls;

whereby a person may step onto one of said platform cylinders and therefrom onto the birling cylinder, which then rotates relative to the main support pipe, while being slowed by water in the pool contacting the paddle-wheel vanes; and whereby any person falling, pushed, or jumping onto any portion of the birling cylinder or platforms will strike a soft surface.

11. An apparatus as in claim 10, in which there is also a safety pad covering some or all exposed portions of said brackets.

12. An apparatus as in claim 10, in which said free rotation is ensured by ball-bearings.

13. An apparatus as in claim 10, in which the mounting brackets are adjustable so that the main support pipe may be at different heights relative to water level.

14. An apparatus for birling in a swimming pool consisting in:

(a) a birling cylinder consisting in:

(i) a birling pipe of plastic or similar strong material, characteristically of eighteen to twenty-four inch diameter, covered longitudinally with a characteristically one inch thick poly sponge or other cushioning coating;

(ii) two paddle wheels, one at each end of and within the birling pipe, and each consisting of several vanes affixed to the inner surface of said pipe, oriented parallel to said pipe's longitudinal central axis, and radially extending from said pipe towards said central axis;

(iii) a birling cylinder support pipe, characteristically metal and three inches in diameter, to which said vanes affix;

(b) two stationary platform cylinders, characteristically of the same diameter and coating as said birling cylinder, except that said platform cylinders are flattened on top to afford safe walking thereon; and each is oriented longitudinally parallel to the birling cylinder and extends between one end of the birling cylinder and one of two facing vertical walls of the swimming pool; and each has a central platform support pipe running longitudinally through it;

(c) a non-rotating main support pipe, characteristically of metal and two-inch diameter, running centrally through the birling cylinder support pipe; and through the platform support pipes and firmly affixed thereto;

(d) ball-beatings of some suitably strong substance which will not corrode in water, arrayed between the main support pipe and the birling cylinder support pipe, characteristically on twelve-inch centers; and (e) two mounting brackets, each of which is affixed by known means to one of said walls, such that a line drawn between the centers of said brackets is horizontal and perpendicular to said walls; the main support pipe or the platform support pipes or both being mounted in said mounting brackets;

whereby a person may step directly from a patio or other poolside surface onto one of said platform cylinders and therefrom onto the birling cylinder, and may by movement of their feet or other body parts initiate the rotation of said cylinder, which then rotates relative to the main support pipe by virtue of the ball bearings, while being slowed by water in the pool contacting the paddle-wheel vanes; and whereby any person falling, pushed, or jumping onto any portion of the birling cylinder or platforms will strike a soft surface.

15. An apparatus as in claim 14, in which there is also a safety pad, characteristically of cushioning foam, mounted on the poolside surface or patio adjacent to each platform cylinder, and covering any exposed portions of the mounting brackets.

16. An apparatus as in claim 15, in which the mounting brackets have a portion that extends horizontally across and contacts the poolside or patio surface; said horizontal portion being under the safety pad.

17. An apparatus as in claim 14, in which the mounting brackets are adjustable so that the main support pipe may be affixed at different heights relative to water level.

18. An apparatus as in claim 14, in which the platform cylinders are impervious to water and buoyant, and optionally filled with a flotation material such as foam.

19. Apparatus for simulating birling in a body of water comprising:

an elongated shaft;

an elongated cylinder simulating a log mounted for free rotation about said shaft and having at least one paddle wheel fixed in the interior thereof for conjoint rotation therewith; and means for mounting said shaft between a pair of spaced supports so that said cylinder is at least partially submerged in the body of water, said mounting means being adjustable so as to regulate the depth of said cylinder and paddle wheels in said water so as to control the speed of rotation of said cylinder.

* * * * *